US007882999B2

(12) United States Patent
Canning

(10) Patent No.: US 7,882,999 B2
(45) Date of Patent: Feb. 8, 2011

(54) METHOD OF FORMING A PAPERBOARD BLANK WITH ATTACHED GIFTWRAPPING PAPER INTO ONE COMPONENT OF A GIFTBOX WITH SQUARE CORNERS

(76) Inventor: Timothy A. Canning, 5109 Sandlewood Dr., Raleigh, NC (US) 27609

( * ) Notice: Subject to any disclaimer, the term of this patent is extended or adjusted under 35 U.S.C. 154(b) by 0 days.

(21) Appl. No.: 12/348,730

(22) Filed: Jan. 5, 2009

(65) Prior Publication Data

US 2009/0173772 A1 Jul. 9, 2009

Related U.S. Application Data

(60) Provisional application No. 61/018,916, filed on Jan. 4, 2008.

(51) Int. Cl.
*B65D 5/62* (2006.01)
*B31B 17/02* (2006.01)
*B31B 17/14* (2006.01)

(52) U.S. Cl. ..... 229/116.5; 229/164.1; 229/923; 493/110

(58) Field of Classification Search ..... 229/87.18, 229/87.19, 116.5, 923, 164.1; 493/93, 96, 493/100, 110
See application file for complete search history.

(56) References Cited

U.S. PATENT DOCUMENTS 1,152,353 A * 8/1915 Schwerdtle ..... 229/164.1
1,402,259 A * 1/1922 Smith ..... 493/110
1,758,511 A * 5/1930 Gross ..... 229/125.19
2,062,085 A * 11/1936 Claff ..... 229/182
2,697,546 A * 12/1954 Bergstein ..... 229/162.1
2,769,588 A * 11/1956 Beck ..... 229/116.5
2,932,439 A * 4/1960 Sparling ..... 229/182
3,343,750 A * 9/1967 Desmond et al. ..... 229/87.19
3,355,092 A * 11/1967 Le Pain ..... 229/87.19
3,366,304 A * 1/1968 Peckar et al. ..... 229/116.5
3,391,856 A * 7/1968 Siegler ..... 229/87.19
3,434,645 A * 3/1969 Prisco ..... 229/164.1
3,459,358 A * 8/1969 Adams, Jr. ..... 229/190
3,460,738 A * 8/1969 Adams, Jr. et al. ..... 229/132
3,790,069 A * 2/1974 Straccamore ..... 229/87.19
3,829,005 A * 8/1974 Hackenberg et al. ..... 229/132

(Continued)

*Primary Examiner*—Gary E Elkins
(74) *Attorney, Agent, or Firm*—Thomas, Kayden, Horstemeyer & Risley, LLP.

(57) ABSTRACT

This invention is a paperboard box and a lid having a paper with a design placed on the outside surface. The paper is held in position by being glued to the inside of the finished carton. The box or lid has four squared corners. The finished decorative box has adhesive on the interior panels and may be shipped in flat form and erected at or near the point of use. Because the paper is thick it is difficult to form square corners on the box or lid. The box or lid has a paperboard web between a side panel and an end panel which is folded to make a square corner. It has been found that a slit can be cut in the paper bisecting the corner which will allow the paper to be folded without bunching and making an attractive square corner. Once the slit is cut in the paper the side and end panels can be folded to produce a square corner without any bulging paper. The bulging paper is not attractive as a gift-wrap box and also may prevent the locking of the corner as required to form a box and lid with square corners.

4 Claims, 7 Drawing Sheets

U.S. PATENT DOCUMENTS 4,005,814 A * 2/1977 Foster ..... 229/155
4,244,508 A * 1/1981 Schulman ..... 229/182
4,765,535 A * 8/1988 Michetti ..... 229/172
4,795,084 A * 1/1989 Hartman ..... 229/175
5,044,547 A * 9/1991 Hartman ..... 229/175
5,364,015 A * 11/1994 Hirschey ..... 229/116.5
5,584,429 A * 12/1996 Savage ..... 229/103.3
5,845,841 A * 12/1998 Canning ..... 229/116.5
5,992,732 A * 11/1999 Canning ..... 229/116.5
6,604,674 B1 * 8/2003 Bowman ..... 229/116.5

* cited by examiner

METHOD OF FORMING A PAPERBOARD BLANK WITH ATTACHED GIFTWRAPPING PAPER INTO ONE COMPONENT OF A GIFTBOX WITH SQUARE CORNERS

CROSS-REFERENCE TO RELATED APPLICATION

This application claims priority to copending U.S. provisional application entitled, "PRE-SLIT CORNERS IN THE WRAPPING PAPER FOR A GIFT CARTON," having Ser. No. 61/018,916, filed Jan. 4, 2008, which is entirely incorporated herein by reference.

TECHNICAL FIELD

This invention is related to a decorated wrapped box and method for pre-slitting the corners of the decorative paper and folding the web corner of the box to ensure an easy to fold and attractive square corner on the gift-wrapped box.

BACKGROUND OF THE INVENTION

Boxes having square corners have many applications in specialty decorative boxes, especially for gift packages. Boxes that are shipped in collapsed form or set up form are disclosed in U.S. Pat. No. 4,795,084, to Hartman, entitled "Corner Structure and Blank for a Tray or Tray Cover", and U.S. Pat. No. 5,845,841 to Canning entitled "Multi-Ply Carton Blank and Method of Forming Blank", which are herein incorporated by reference.

The retailer and the retailer's customers may desire that these boxes be pre-wrapped with a thin foil or plastic that has an attractive print to present an attractive gift box. As the foil or plastic is usually very thin it is fairly easy to laminate or attach the plastic or the foil to the paperboard. It is also fairly easy to make square corners on the boxes because the foil or plastic is thin. However, many times it is desirable to use decorative paper which is much thicker and more difficult to form a square corner as the paper may wrinkle and may prevent the box corners from locking.

SUMMARY OF THE INVENTION

This invention is an improvement on the invention disclosed in U.S. Pat. No. 4,795,084, to Hartman ("Hartman patent") which discloses forming a box and a lid having squared corners. The method for forming and setting up the blank is disclosed in the Hartman patent. The box and the lid usually have paper or foil or plastic with a printed attractive design attached to it by lamination or glue, usually to selected positions on the inside of the container. As the plastic or foil is very thin it is fairly easy to form square corners using this thin material. However, when paper with the printed design is used it is difficult to form a square corner because of the thickness of the paper. The box or lid basically has a web between a side panel and an end panel which is folded to make a square corner. It has been found that the paper covering the foldable paperboard web can be slit at the bisecting paperboard corner of the web to allow the paper to be folded into two sections, when folding and locking both the web corner and end panel. These two sections of paper project beyond the web corner, and are separated at the slit when folding, tucking and locking the ends of the paperboard web corner. This slit allows the paper to be folded without bunching up and makes an attractive square corner Bulging paper is not attractive on a gift-wrap box and also may prevent the locking of the corner as required by the Hartman patent and other designs for forming a box and lid with square corners.

BEST MODE OF CARRYING OUT THE INVENTION

Figure 1:
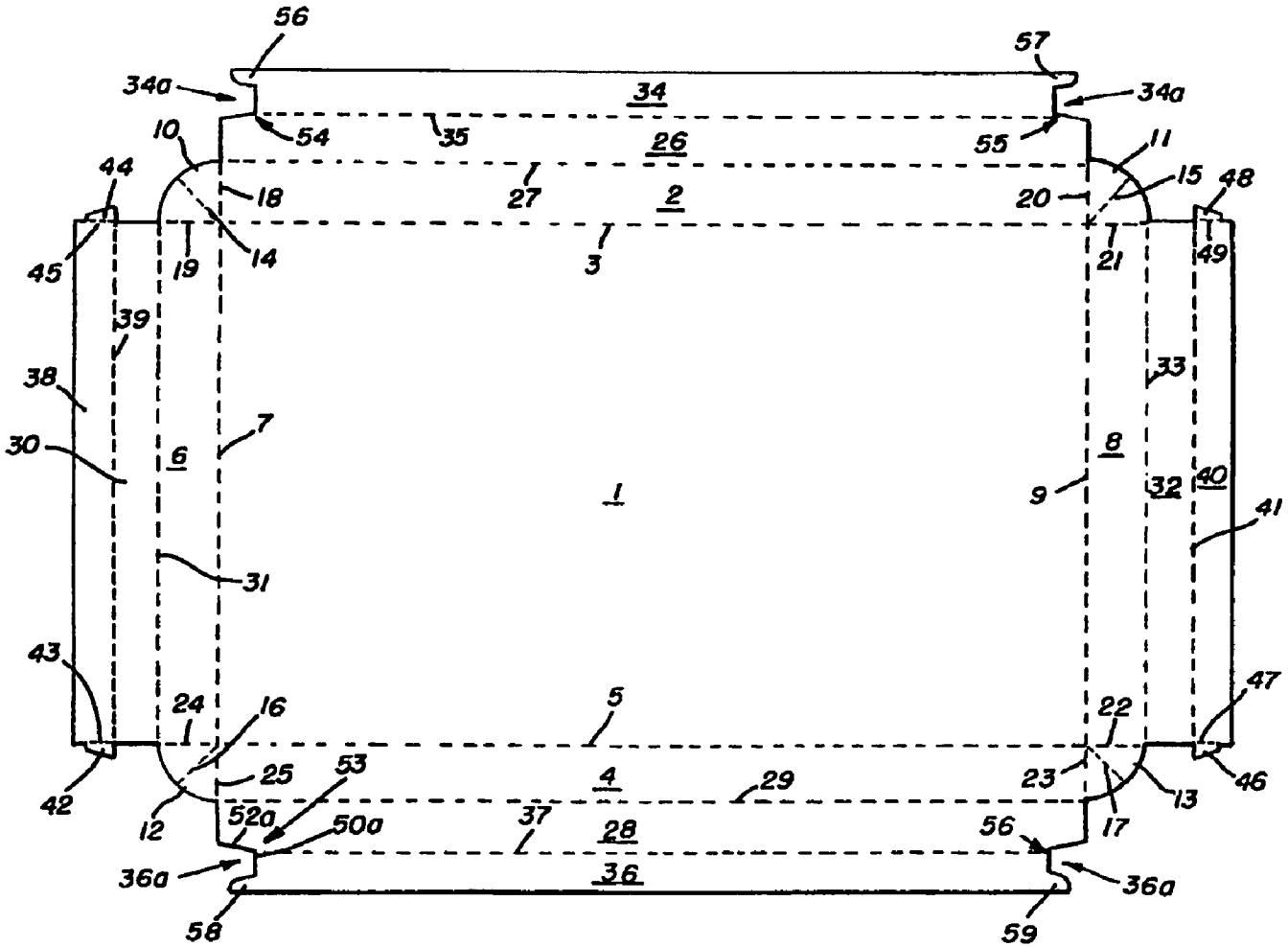
FIG. 1 is a plan view of a blank formed according to this invention as viewed from the inside of the blank.

With reference primarily to FIG. 1, the numeral 1 designates the main quadrilateral panel of the blank having right angle corners. Outer side panel 2 is foldably joined to main panel 1 along fold line 3 while outer side panel 4 is foldably joined to main panel 1 along fold line 5. Outer end panel 6 is foldably joined to main panel 1 along a fold line 7 and outer end panel 8 is foldably jointed to main panel 1 along fold line 9.

The outer side and end panels are interconnected by web structures 10, 11, 12 and 13 which are disposed at the four corners of main panel 1. Each web structure is collapsible along a fold line such as indicated at 14, 15, 16 and 17. Web 10 is foldably joined to outer side panel 2 along fold line 18 and to the adjacent end of outer end panel 6 along fold line 19. Web 11 is foldably joined to outer side panel 2 along fold line 20 and to outer end panel 8 along fold line 21 while web 13 is foldably joined along fold line 22 to the end of outer end panel 8 and along fold line 23 to the end of outer side panel 4. Web 12 is foldably joined to outer end panel 6 along fold line 24 and to outer side panel 4 along fold line 25.

Outer side and end panels 2, 4, 6 and 8 are reinforced. For example, inner side panel 26 is foldably joined to outer side panel 2 along a fold line 27 while inner side panel 28 is foldably joined to outer side panel 4 along fold line 29. In like fashion, inner end panel 30 is foldably joined to outer end panel 6, along fold line 31 and inner end panel 32 is foldably joined to outer end panel 8 along fold line 33.

When the tray is assembled, inner side and end panels 26, 28, 30 and 32 are disposed in flat face contacting relation with the outer side and end panels 2, 4, 6 and 8 respectively.

Base panel 34 is foldably joined to inner side panel 26 along fold line 35 while base panel 36 is foldably joined to inner panel 28 along fold line 37. Base panel 38 is foldably joined to inner end panel 30 along fold line 39 and base panel 40 is foldably joined to inner end pane 32 along fold line 41. Base panels 34, 36, 38 and 40 are disposed in flat face contacting relation with main panel 1 when the tray is set up.

Figure 4:
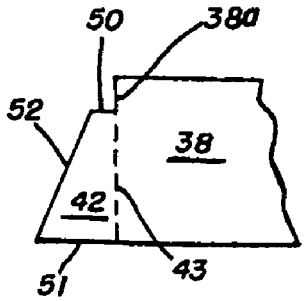
FIG. 4 is an enlarged fragmentary view of a locking tab and the panel to which it is adjoined.

For locking the elements in set up condition, locking tab 42 is foldably joined along fold line 43 to one end of base panel 38 and a similar locking tab 44 is foldably joined to the opposite end of base panel 38 along fold line 45. The short parallel edge 50 of locking tab 42 is spaced from the outer edge of base panel 38. At the other end of the blank, locking tab 46 is foldably joined to base panel 40 along fold line 47 and locking tab 48 is foldably joined to base panel 40 along fold line 49. All of the locking tabs are of identical construction. It is obvious from an inspection of these tabs that they are of trapezoidal configuration. As is clear from FIG. 4, tab 42, for example, is defined by its fold line 43, its short parallel edge 50 and its longer parallel edge 51 together with the angularly disposed edge 52. Edges 50, 51 and 52 are exposed and free of attachment to any other element.

For cooperating with the locking tabs, each end of each inner side panel 26 and 28 is cutaway at its outer corners to define a cutaway area partially indicated by edges of the cutout section. For example the short parallel edge 50 of locking tab 42 engages the short transverse edge or cut line 50*a* of the cutout corner portion of inner side panel 28. Edge 38*a* of base panel 38 engages inner side panel 28 adjacent fold line 37 and holds the inner side panel 28 in a normal position relative to main panel 1 and prevents collapse of the inner side panel 28. In like fashion, the cut edge 52*a* of cutaway area 53 abuts and coincides with the edge 52 of the locking tab 42. All of the locking tabs are configured in a manner identical to locking tab 42 and cooperation of locking tabs 44, 46 and 48 with associated cutaway areas 54, 56 and 55 is identical to that of locking tab 42 and its cutaway area 53.

Extending tabs 56 and 57 are formed at the outer corners of base flap 34 while identical extending tabs 58 and 59 are formed at the outer corners of base flap 36.

The cutaway end portions of the base panels 34 and 36 which are designated by the arrows 34*a* and 36*a* serve to facilitate locking and holding action of locking tabs 44, 48, 42 and 46. For example and with reference to locking tab 42, cutaway area 36*a* affords space into which the lower edge 43 of locking tab 42 is pressed. The memory or "flight" along fold line 43 causes tab 42 to press against the inner surface of outer side panel 4 and also causes edge 52 to engage securely the edge 52*a* while locking tab 42 snaps into secure locking position without overlapping edge 52*a*.

Figure 2:
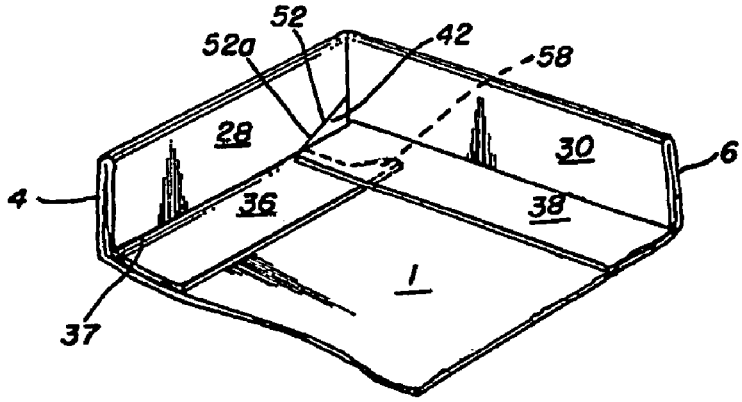
FIG. 2 is a fragmentary view of one corner of the container as viewed from inside when formed in set up condition.

In order to set up the carton so that each corner appears from the inside as shown in FIG. 2, the inner side panel 28 is folded inwardly along fold line 29 and the outer side panel 4 together with associated structure is folded along the fold line 5 into vertical position so as to cause the base flap 36 to lie in flat face contacting relation against the main panel 1. After panel 28 is in vertical position, inner end panel 30 is folded along fold line 31 into flat face contacting relation with the outer end panel 6 and outer end panel 6 is folded into perpendicular relation to main panel 1 which folding operation causes the base panel 38 to fall into flat face contacting relation with the main panel 1. During these folding operations, the web 12 collapses on fold line 16 and is captured between the adjacent ends of outer end panel 6 and inner end panel 30. During this folding operation, the locking tab 42 swings along its fold line 43 into a perpendicular position relative to main panel 1 and the locking edge 52 of locking tab 42 comes into abutting engagement with the edge 52*a* of cutaway area 53 and the set up corner appears as shown from inside in FIG. 2.

Figure 3:
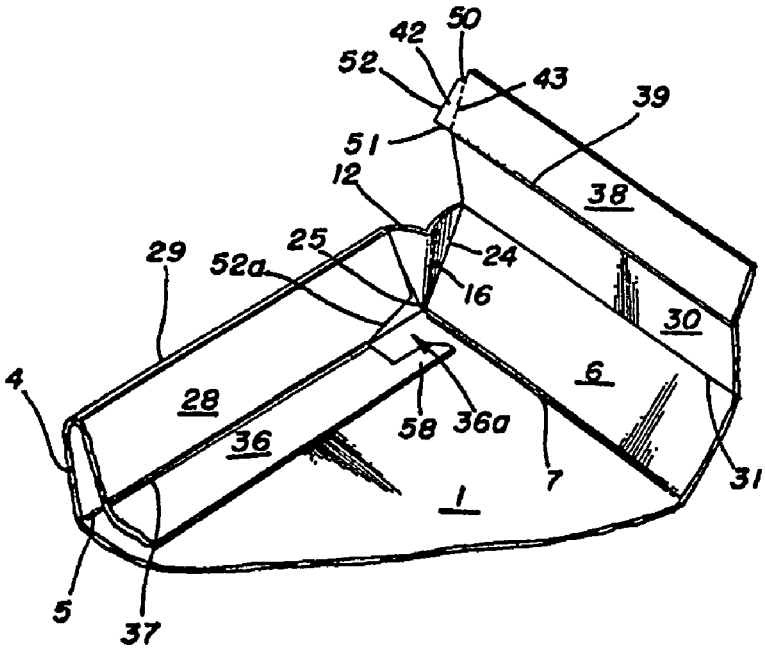
FIG. 3 is a view similar to FIG. 2 but which shows the principal locking elements during an intermediate stage of manipulation between the flat blank shown in FIG. 1 and the completed corner shown in FIG. 2.

FIG. 3 shows the folding of inner side panel 28 and of base panel 36 after completion of their folding operation and shows outer end panel 6, inner side panel 30 and base panel 38 during an intermediate stage of folding from the flat position represented in FIG. 1 to the set up condition shown in FIG. 2.

Figure 5:
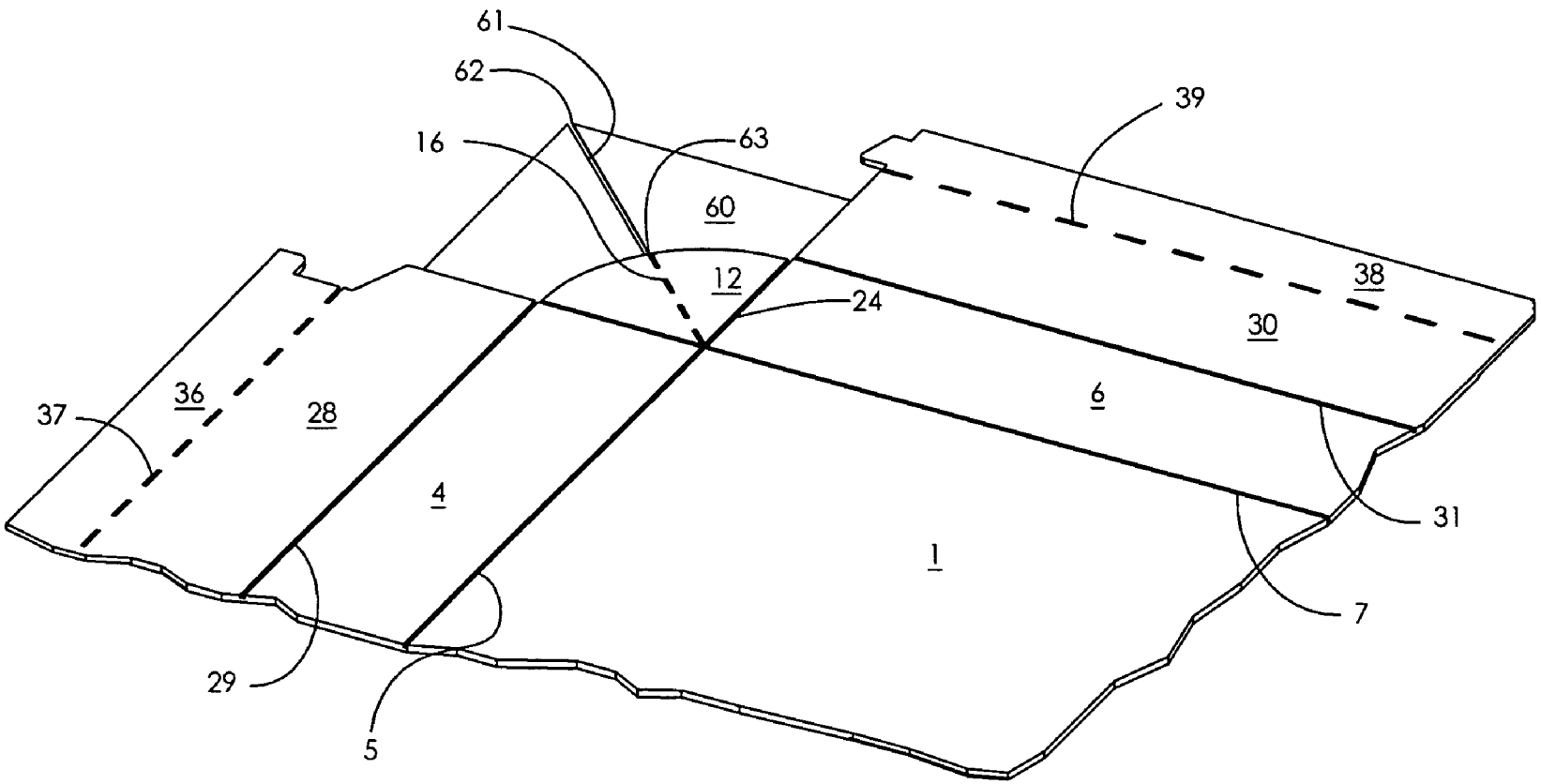
FIG. 5 is a fragmentary view of a corner when viewed from inside with the wrapping paper adhered to the outside of the container when ready to be set up.

FIG. 5 is a fragmentary view of a corner of the container showing that decorative paper 60 has been held in juxtaposition to the outside surface of the container (box) or tray. The paper is usually held to the outside surface by being glued at selected positions on the inside of the container. The outside surface of the lid or tray cover is also covered with paper and corners formed in the same way. The paper may be adhered by glue or lamination to the tray or box. A slit 61 has been cut from the corner 62 of the paper to fold line 16 which bisects web 12. This slit 61 facilitates the folding of the web structure into a neat corner without the paper puckering. It has also been found that the paper 60 needs to have a square corner 62 in order to form a neat corner for the box or tray.

This slit 61 may be cut by a knife, or a jig can be constructed on which to cut the slit. It has been found that the slit 61 does not need to be cut inside the outside edge 63 of the web 12.

Figure 6:
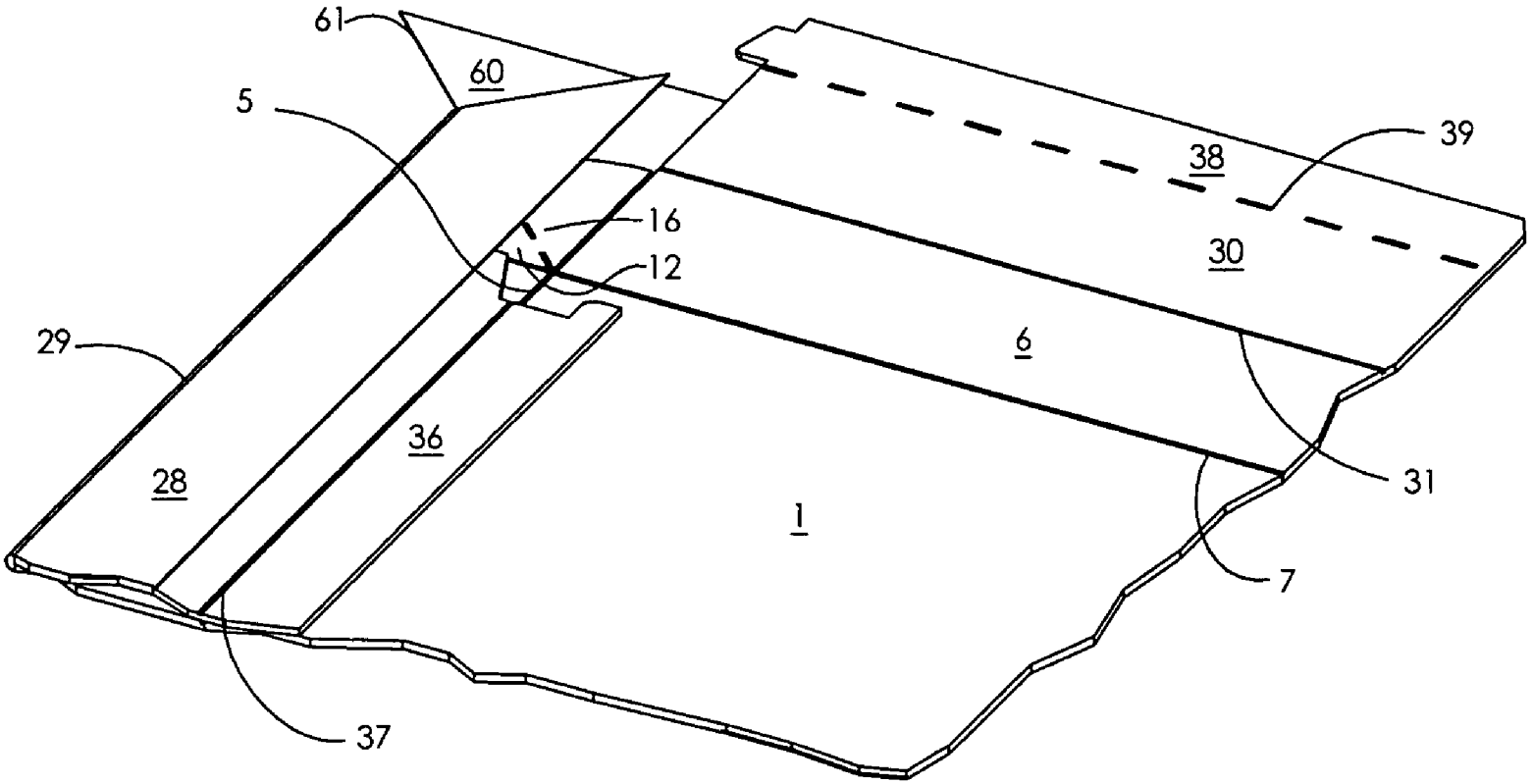
FIG. 6 is an enlarged fragmentary view of the corner of FIG. 5 when viewed from the inside where the paper has been slit bisecting the corner and the paper and the inner side panel to which it has been adhered has been folded inwardly.

FIG. 6 shows the next step in forming a locked corner for the box or tray. Inner side panel 28 is folded inwardly. The paper is held in position to the outside surface of inner side panel 28 and outer side panel 4, usually by glue applied to selected positions on the inside of the container.

Figure 7:
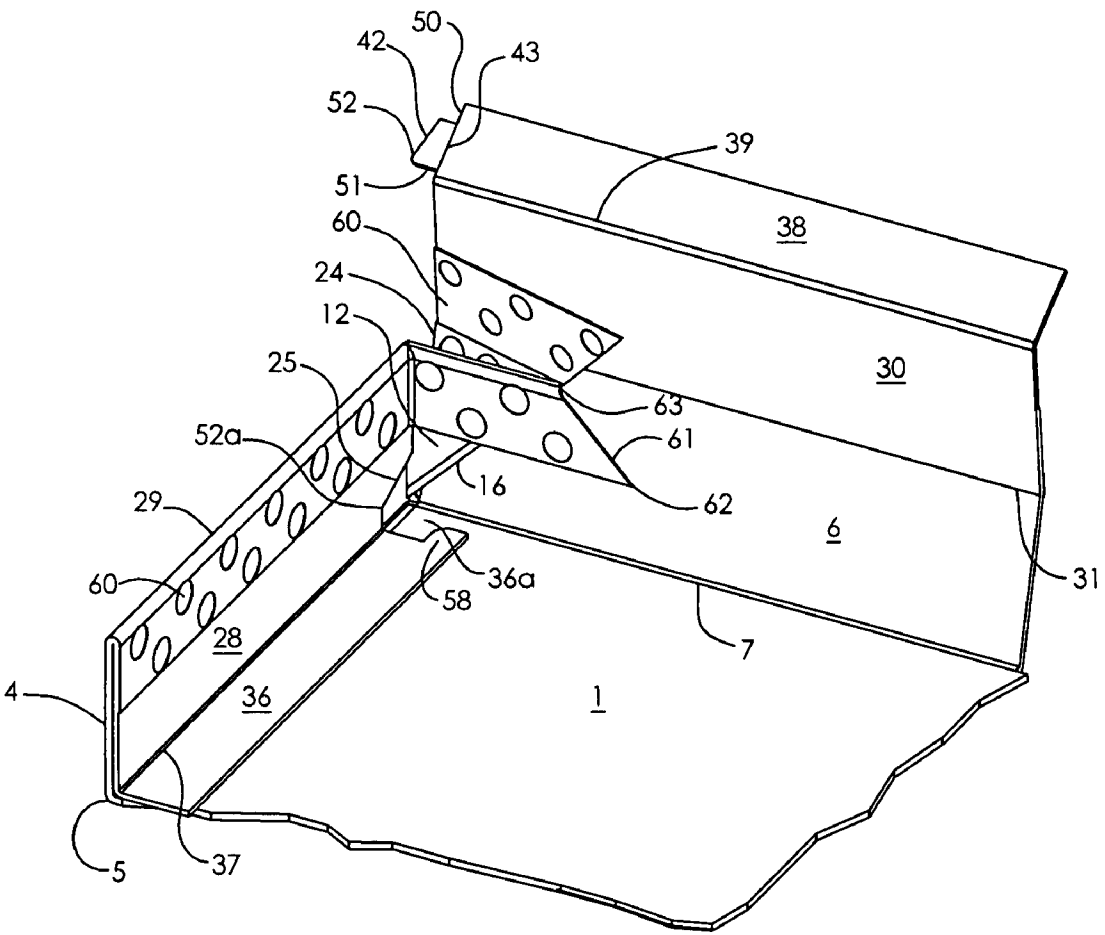
FIG. 7 is a fragmentary view of the corner shown in FIG. 6 showing the inner side panel folded inwardly and the outer end panel being folded inwardly to be locked into a corner.

FIG. 7 shows the next step in forming a locked corner for the box or tray. The outer side panel 4 has been folded into position and outer end panel 6 has been partially folded into the proper position.

Figure 8:
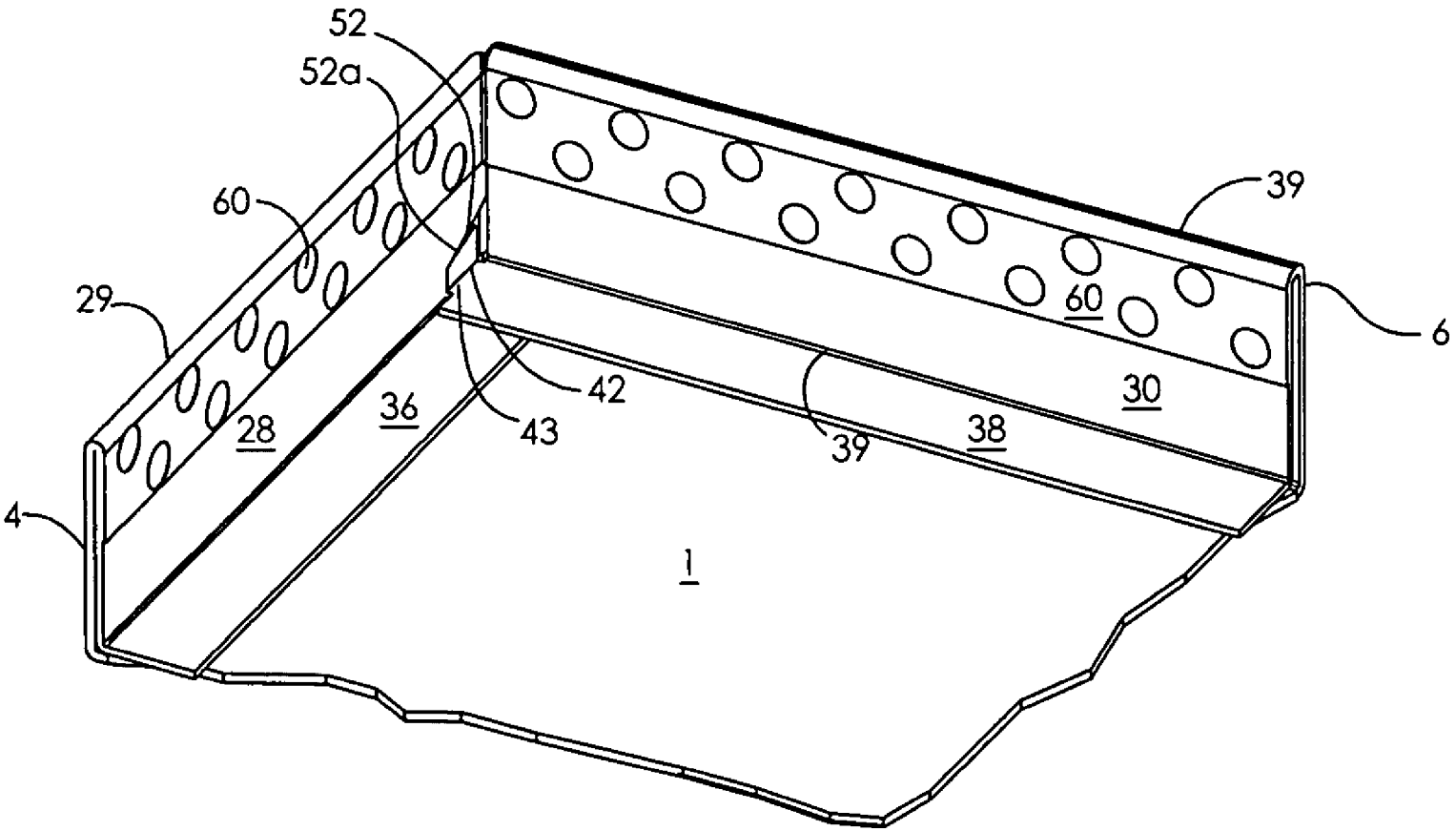
FIG. 8 is a fragmentary view of a corner when viewed from the inside showing the corner in the folded and locked position.
Figure 9:
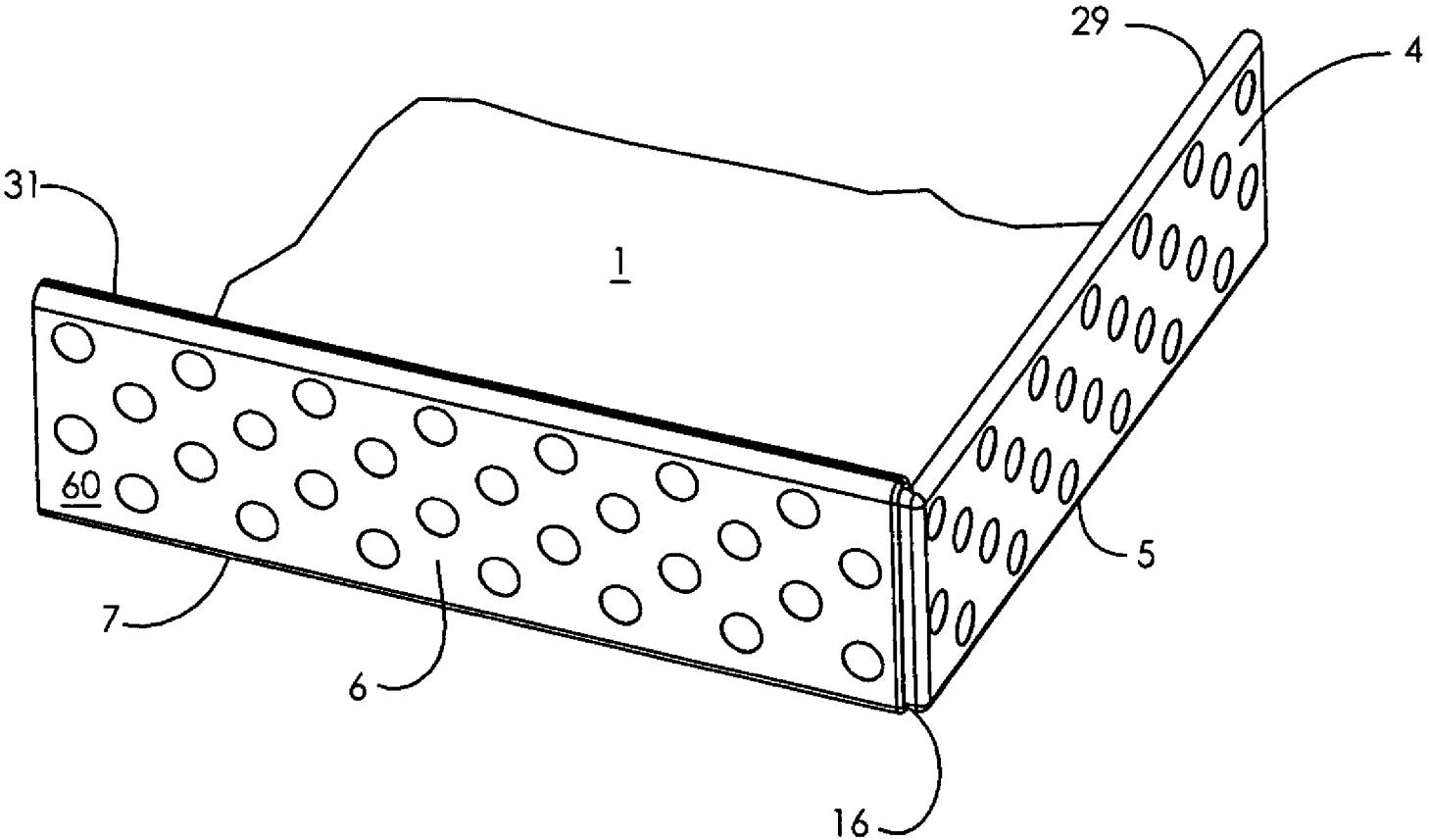
FIG. 9 is a fragmentary view of a corner from the outside of the corner shown in FIG. 8.

FIG. 8 shows the inside of the corner after completion of the folding and locking of the corner. FIG. 9 shows the outside of the corner after completion of the folding and locking of the corner. FIGS. 8 and 9 show that the corner is neatly folded and locked with no bunching of paper which is due to the slitting of the corner of the paper. Numerous attempts have been made in the past to try to fold the paper and lock the corner, but paper has always bunched making an unattractive corner and also frequently making the locking of the corner difficult if not impossible. Anyone who has received a gift wrapped package appreciates the gift more if the package is neatly wrapped and the corners are locked in place.

It is obvious that a tray or tray cover may be formed according to the invention. Minor changes in dimensions would be made to accommodate proper interfitting of the two components as is obvious.

From the foregoing discussion taken in conjunction with the drawing, it is clear that by the invention a sturdy attractive tray or tray cover is provided which requires no glue and which therefore is suitable for use at the retail level to package various items sold to the public and for use in many industrial applications.

While the invention will be described in conjunction with illustrated embodiments, it will be understood that it is not intended to limit the invention to such embodiments. On the contrary, it is intended to cover all alternatives, modifications and equivalents as may be included within the spirit and scope of the invention as defined by the present patent specification as a whole.

What is claimed is:

1. A corner structure for a tray or tray cover of the type formed from a unitary blank of paperboard, said tray or tray cover having an inside and outside surface, said corner structure having a quadrilateral main panel with right angle corners and a pair of outer side panels each having opposite side edges and inner surfaces and said outer side panels having adjacent end edges and being foldably joined along one of said side edges respectively to edges of said main panel along fold lines which intersect at a corner of the tray, said outer side panels being perpendicular to said main panel, collapsed web structure foldably joined to the adjacent end edges of said outer side panels, a pair of inner side panels having opposite edges and foldably joined respectively along one of said edges to the other of said edges of said outer side panels which are remote from said main panel, said inner side panels having adjacent end edges and one of said inner side panels having a lower corner, each of said inner side panels being disposed in flat face contacting relation with the inner surface of its associated outer side panel, one of said inner side panels being of rectangular configuration and the end edge of the other of said inner side panels being configured to define the shorter parallel side of a trapezoid and another diagonal intersecting locking edge of said trapezoid, a base flap foldably joined respectively to each of said inner side panels along a fold line at the other edge thereof which is adjacent said main panel, said base flaps having adjacent ends and being disposed in flat face contacting relation with said main panel and an end edge of the base flap which is foldably joined to said other inner side panel intersecting an end of said shorter parallel side of said trapezoid, and a locking tab of trapezoidal configuration foldably joined along a fold line having a memory to the adjacent end of the one of said base flaps which is foldably joined to said one of said inner side walls, said locking tab having a lower edge and a locking edge and being disposed in perpendicular relation to its associated base flap and with its locking edge in engagement with said locking edge of said other inner side panel, an extending tab integral with and projecting longitudinally from said adjacent end of the one of said base flaps which is foldably joined to said other inner side panel, said extending tab defining a cutaway end portion of its associated base flap which affords space into which the lower edge of the adjacent locking tab is disposed so that the memory along the tab fold line causes the tab to press against the inner surface of the adjacent outer side panel and also causes said locking edge of said locking tab securely to engage said locking edge of said other inner side panel, wherein the improvement comprises decorative paper being held in juxtaposition to the outside surface of the tray or tray cover, said paper forming a corner not supported by paperboard that extends beyond said corner formed by paperboard, said paper having a slit through the mid-section of the paper corner not supported by paperboard, so the paper can be folded with the folding of the paperboard to form a neat square corner when a tray or tray lid is formed.

2. A unitary blank of paperboard for forming a tray or tray cover, said tray or tray cover having an inside and outside surface, with a quadrilateral main panel having right angle corners, a first pair of outer side panels having opposite edges and being foldably joined along one of said edges to a first pair of opposite side edges of said main panel, a first pair of inner side panels having outer corners and opposite edges and being foldably joined respectively along one of said edges to the other of said edges of said first pair of outer side panels which are remote from said main panel, each of the outer corners of said first pair of inner side panels being configured to define cutaway areas to form an angular locking edge and a short transverse edge, a first pair of base flaps each having end edges and outer corners and being foldably joined respectively to the other of said edges of said first pair of inner side panels which are remote from said first pair of outer side panels, a second pair of outer side panels foldably joined respectively to a second pair of opposite side edges of said main panel, each of said first pair of outer side panels and of said second pair of outer side panels having opposite ends which are adjacent respectively to a corner of said main panel, a collapsible web at each corner of said main panel and foldably joined to an end of each one of said first pair of outer side panels and to an end of each one of said second pair of outer side panels, a second pair of inner side panels having opposite edges and being foldably joined respectively along one of said edges to the other of said edges of said second pair of outer side panels which are remote from said main panel, a second pair of base flaps each having opposite ends and being foldably joined respectively to the other of said edges of said second pair of inner side panels which are remote from said second pair of outer side panels, and a locking tab adjoined to each end of each of said second pair of base flaps, said cutaway area forming parts of the edges of a trapezoid and said locking tabs are of trapezoidal configuration each having a free and exposed long and a short parallel side and a third side perpendicular to said long and short sides, the shorter parallel side being spaced from the outer edge of the associated base panel and each of said locking tabs being arranged with its free and exposed longer parallel side in alignment with said edges of said second pair of inner side panels which are remote from said second outer side panels and with its third side foldably joined to the adjacent end edge of the associated one of said base flaps and each locking tab having a tab locking edge configured to match said locking edge of the adjacent cutaway area and said short parallel side being configured for engagement with said short transverse edge of one of said cutaway areas, wherein the improvement comprises decorative paper being held in jutxaposition to the outside surface of the tray or tray cover, said paper extending beyond each web corner formed by paperboard to form a square corner of paper, said paper being slit through the mid-section of each corner of the paper not supported by paperboard, so the paper can be folded with the folding of the paperboard to form a neat square corner when the blank is folded and locked into a tray or tray cover.

3. A method for folding and locking a collapsed box of paperboard with two sides and two ends from a blank having end and side panels with a web in between each side and end for forming a corner, said blank having an outside surface to which paper with a design is held in juxtaposition, said paper extending beyond each web corner of paperboard to form a square corner of paper not supported by paperboard, said method comprising forming a slit in each corner of the paper extending to the paperboard web in said corner of the blank, and folding and locking the sides and ends of the blank to form the box with four square neat corners.

4. The method of claim 3 in which the blank has a quadrilateral main panel having right angle corners, a first pair of outer side panels having opposite edges and being foldably joined along one of said edges to a first pair of opposite side edges of said main panel, a first pair of inner side panels having outer corners and opposite edges and being foldably joined respectively along one of said edges to the other of said edges of said first pair of outer side panels which are remote from said main panel, each of the outer corners of said first pair of inner side panels being configured to define cutaway areas to form an angular locking edge and a short transverse edge, a first pair of base flaps each having end edges and outer corners and being foldably joined respectively to the other of said edges of said first pair of inner side panels which are remote from said first pair of outer side panels, a second pair of outer side panels foldably joined respectively to a second pair of opposite side edges of said main panel, each of said first pair of outer side panels and of said second pair of outer side panels having opposite ends which are adjacent respectively to a corner of said main panel, a collapsible web at each corner of said main panel and foldably joined to an end of each one of said first pair of outer side panels and to an end of each one of said second pair of outer side panels, a second pair of inner side panels having opposite edges and being foldably joined respectively along one of said edges to the other of said edges of said second pair of outer side panels which are remote from said main panel, a second pair of base flaps each having opposite ends and being foldably joined respectively to the other of said edges of said second pair of inner side panels which are remote from said second pair of outer side panels, and a locking tab adjoined to each end of each of said second pair of base flaps, said cutaway area forming parts of the edges of a trapezoid and said locking tabs are of trapezoidal configuration each having a free and exposed long and a short parallel side and a third side perpendicular to said long and short sides, the shorter parallel side being spaced from the outer edge of the associated base panel and each of said locking tabs being arranged with its free and exposed longer parallel side in alignment with said edges of said second pair of inner side panels which are remote from said second outer side panels and with its third side foldably joined to the adjacent end edge of the associated one of said base flaps and each locking tab having a tab locking edge configured to match said locking edge of the adjacent cutaway area and said short parallel side being configured for engagement with said short transverse edge of one of said cutaway areas.

* * * * *